US005854192A

United States Patent [19]

Boskamp

[11] Patent Number: 5,854,192

[45] Date of Patent: Dec. 29, 1998

[54] PARTICULATE ZERO-PHOSPHATE ALUMINOSILICATE-BUILT DETERGENT COMPOSITIONS COMPRISING SILICATE/ CARBONATE COGRANULES

[75] Inventor: Jelles Vincent Boskamp, Vlaardingen, Netherlands

[73] Assignee: Lever Brothers Company, Division of Conopco, Inc., New York, N.Y.

[21] Appl. No.: 852,617

[22] Filed: May 7, 1997

[30] Foreign Application Priority Data

May 9, 1996 [GB] United Kingdom ..... 9609699

[51] Int. Cl.[6] ..... C11D 3/10; C11D 3/08; C11D 3/12; C11D 3/39

[52] U.S. Cl. ..... 510/315; 510/377; 510/438; 510/509; 510/511

[58] Field of Search ..... 510/509, 510, 510/511, 512, 507, 531, 532, 438, 315, 377; 252/236, 246, 160

[56] References Cited

U.S. PATENT DOCUMENTS

| | | | |
|---|---|---|---|
| 4,288,342 | 9/1981 | Wagner, III et al. | 252/140 |
| 5,674,823 | 10/1997 | Ricca et al. | 510/102 |

FOREIGN PATENT DOCUMENTS

| | | |
|---|---|---|
| 340013 | 11/1989 | European Pat. Off. . |
| 367339 | 5/1990 | European Pat. Off. . |
| 384070 | 8/1990 | European Pat. Off. . |
| 390251 | 10/1990 | European Pat. Off. . |
| 420317 | 4/1991 | European Pat. Off. . |
| 0 488 868 | 6/1992 | European Pat. Off. . |
| 561656 | 12/1993 | European Pat. Off. . |
| 658517 | 6/1995 | European Pat. Off. . |
| 667391 | 8/1995 | European Pat. Off. . |
| 735 132 | 10/1996 | European Pat. Off. . |
| 735 132A | 10/1996 | European Pat. Off. . |
| 0 774 505 A | 5/1997 | European Pat. Off. . |
| 69867 | 10/1996 | Israel . |
| WO 95 32273A | 5/1995 | WIPO . |
| WO 95/22592 | 8/1995 | WIPO . |
| WO 95/32273 | 11/1995 | WIPO . |
| 96/17045 | 6/1996 | WIPO . |
| WO 96/17045 | 6/1996 | WIPO . |

OTHER PUBLICATIONS

Derwent Abstract of EP 667391 Published Aug. 15, 1995.
Derwent Abstract of WO 95/22592 Published Aug. 24, 1995.
Derwent Abstract of WO 95/32273 Published Nov. 30, 1995.
International Search Report for PCT/EP97/02496, dated Sep. 17, 1997.
Derwent Abstract of EP 735 132A Published Oct. 2, 1996.
Derwent Abstract of WO 96/17045 Published Jun. 6, 1996.

*Primary Examiner*—Ardith Hertzog
*Attorney, Agent, or Firm*—Rimma Mitelman

[57] ABSTRACT

In order to provide a particulate zero-phosphate laundry detergent composition with reduced tendency to agglomeration, the composition comprises:

i) from 30 to 80 wt % of a granular base powder comprising:
   a) from 5 to 60 wt % (based on the composition) of organic surfactant, and
   b) from 10 to 80 wt % (based on the composition) of alkali metal aluminosilicate detergency builder, ii) from 1 to 5 wt % of sodium silicate not within the granular base powder, wherein the sodium silicate (ii) is all present in the form of separate cogranules consisting essentially of sodium silicate and sodium carbonate in a ratio within the range of from 3:1 to 1:3, and where the tendency of the composition to form granules having a particle size of 2000 $\mu$m or larger on storage is less than if the sodium silicate (ii) were present in the form of separate granules of sodium disilicate. Optionally, the composition may comprise from 1–50 wt % of separate granules of sodium carbonate, 10 to 35 wt % of separate granules of a peroxy bleach compound and other detergent materials up to 100 wt %.

12 Claims, No Drawings

PARTICULATE ZERO-PHOSPHATE ALUMINOSILICATE-BUILT DETERGENT COMPOSITIONS COMPRISING SILICATE/CARBONATE COGRANULES

TECHNICAL AREA

The present invention relates to particulate zero-phosphate laundry detergent compositions containing sodium silicate. More particularly it relates to particulate laundry detergent compositions built with zeolite MAP and containing sodium percarbonate bleach.

BACKGROUND AND PRIOR ART

Sodium silicate is a well-known ingredient for particulate laundry detergent compositions, and its incorporation is desirable for a number of reasons, for example, in order to provide increased protection against corrosion of metal surfaces within the washing machine, and to control alkalinity and pH in the wash. Granular sodium disilicate (hydrated), which can simply be dry mixed with other powder ingredients, provides a convenient route for the incorporation of this ingredient, especially for powders in which the base powder contains zeolite.

It has been found that certain particulate zeolite-built bleaching laundry detergent compositions containing discrete sodium disilicate granules show a tendency towards "granulation", ie to the formation of large particles, on usage in the home. This occurs once the composition has been exposed to ambient conditions by opening the packaging, even when ambient conditions are relatively dry.

This problem has been observed more particularly in compositions in which the detergency builder is zeolite MAP, the novel zeolite described and claimed in EP 384 070B (Unilever), which is P-type zeolite having a silicon to aluminium ratio not exceeding 1.33. The incidence of "granulation" is also greater in powders containing sodium percarbonate bleach than in similar powders containing sodium perborate monohydrate.

It has now been found that, in compositions where a tendency toward "granulation" has been observed, the problem may be alleviated by replacing the sodium disilicate granules by sodium silicate/sodium carbonate cogranules.

Sodium silicate/sodium carbonate cogranules and their use in detergent compositions are disclosed in EP 561 656A (Rhône-Poulenc), EP 658 617A and EP 667 391A (Degussa), and WO 95 22592A (Henkel).

WO 95 32273A (Rhône-Poulenc) discloses the use of a cogranule of carbonate and silicate to stabilise a detergent composition containing sodium percarbonate.

EP 488 868 (Rhône-Poulenc) discloses the use of a cogranule of carbonate and silicate in a sodium perborate containing powdered composition, wherein a high level of silicate is present in the composition.

DEFINITION OF THE INVENTION

The present invention provides a particulate zero-phosphate laundry detergent composition comprising:

(i) from 30 to 80 wt % of a granular base powder comprising
  (a) from 5 to 60 wt % (based on the composition) of organic surfactant, and
  (b) from 10 to 80 wt % (based on the composition) of alkali metal aluminosilicate detergency builder, (ii) from 1 to 5 wt % of sodium silicate not within the granular base powder, (iii) optionally from 1 to 50 wt % of separate granules of sodium carbonate, (iv) optionally from 10 to 35 wt % of separate granules of a peroxy bleach compound; and (v) optionally other detergent ingredients to 100 wt %, characterised in that the sodium silicate (ii) is all present in the form of separate cogranules consisting essentially of sodium silicate and sodium carbonate in a ratio within the range of from 3:1 to 1:3, whereby the tendency of the composition to form granules having a particle size of 2000 μm or larger on storage is less than if the sodium silicate (ii) were present in the form of separate granules of sodium disilicate.

The invention further provides the use of postdosed cogranules consisting essentially of sodium silicate and sodium carbonate in a ratio within the range of from 3:1 to 1:3 in a particulate zero-phosphate zeolite-built detergent composition otherwise free of postdosed sodium silicate to reduce the tendency of the composition to form granules having a particle size of 2000 μm or above on storage.

DETAILED DESCRIPTION OF THE INVENTION

The invention is based on the observation that certain zeolite-built laundry detergent powders containing postdosed granular sodium disilicate show a tendency to "granulation", ie particle size increase, on storage in contact with the atmosphere, for example, in open packages; and that this problem is solved by replacing the postdosed granular sodium disilicate with sodium silicate/sodium carbonate cogranules.

The particulate laundry detergent composition

The compositions of the invention comprise as essential ingredients:

(i) a multi-ingredient granular base powder comprising organic surfactant and alkali metal aluminosilicate builder, and (ii) sodium silicate in the form of separate composite sodium silicate/sodium carbonate granules.

Further separate granular or particulate ingredients may optionally and desirably be present, notably, (iii) granular sodium carbonate, and (iv) peroxy bleach ingredients, especially sodium percarbonate.

The granular base powder

The granular base powder contains at least one organic surfactant.

Detergent-active compounds or surfactants may be chosen from soap and non-soap anionic, cationic, nonionic, amphoteric and zwitterionic detergent-active compounds, and mixtures thereof. Many suitable detergent-active compounds are available and are fully described in the literature, for example, in "Surface-Active Agents and Detergents", Volumes I and II, by Schwartz, Perry and Berch.

The preferred detergent-active compounds that can be used are soaps and synthetic non-soap anionic and nonionic compounds.

Anionic surfactants are well-known to those skilled in the art. Examples include alkylbenzene sulphonates, particularly linear alkylbenzene sulphonates having an alkyl chain length of $C_8$–$C_{15}$; primary and secondary alkylsulphates, particularly $C_8$–$C_{15}$ primary alkyl sulphates; alkyl ether sulphates; olefin sulphonates; alkyl xylene sulphonates; dialkyl sulphosuccinates; and fatty acid ester sulphonates. Sodium salts are generally preferred.

Nonionic surfactants that may be used include the primary and secondary alcohol ethoxylates, especially the $C_8$–$C_{20}$ aliphatic alcohols ethoxylated with an average of from 1 to 20 moles of ethylene oxide per mole of alcohol, and more especially the $C_{10}$–$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

The total amount of surfactant present is suitably from 5 to 60 wt %, and preferably from 5 to 40 wt %.

Laundry detergent compositions suitable for use in most automatic washing machines generally contain anionic non-soap surfactant, or nonionic surfactant, or combinations of the two in any ratio, optionally together with soap.

The detergent composition of the invention also contains an alkali metal, preferably sodium, aluminosilicate builder. This is suitably present in an amount of from 10 to 80 wt %, preferably from 15 to 70 wt % and more preferably from 20 to 60 wt %.

The alkali metal aluminosilicate may be either crystalline or amorphous or mixtures thereof, having the general formula:

$$0.8\text{–}1.5\ Na_2O.\ Al_2O_3.\ 0.8\text{–}6\ SiO_2$$

These materials contain some bound water and are required to have a calcium ion exchange capacity of at least 50 mg CaO/g. The preferred sodium aluminosilicates contain 1.5–3.5 $SiO_2$ units (in the formula above). Both the amorphous and the crystalline materials can be prepared readily by reaction between sodium silicate and sodium aluminate, as amply described in the literature.

The crystalline materials (zeolites) are preferred. The preferred detergent zeolites are zeolites A (4A), X, and, most preferably, maximum aluminium zeolite P (zeolite MAP) as described and claimed in EP 384 070B (Unilever). Zeolite MAP is defined as an alkali metal aluminosilicate of the zeolite P type having a silicon to aluminium ratio not exceeding 1.33, and preferably not exceeding 1.07. The calcium binding capacity of zeolite MAP is generally at least 150 mg CaO per g of anhydrous material.

Preferred compositions of the invention contain zeolite MAP, suitably in an amount of from 20 to 60 wt %, and are free of zeolite A.

Supplementary builders may also be present. These are generally organic. Organic builders that may be present include polycarboxylate polymers such as polyacrylates, acrylic/maleic copolymers, and acrylic phosphinates; monomeric polycarboxylates such as citrates, gluconates, oxydisuccinates, glycerol mono-, di- and trisuccinates, carboxymethyloxysuccinates, carboxymethyloxymalonates, dipicolinates, hydroxyethyliminodiacetates, alkyl- and alkenylmalonates and succinates; and sulphonated fatty acid salts.

Especially preferred organic builders are citrates, suitably used in amounts of from 5 to 30 wt %, preferably from 10 to 25 wt %; and acrylic polymers, more especially acrylic/maleic copolymers, suitably used in amounts of from 0.5 to 15 wt %, preferably from 1 to 10 wt %.

The total amount of detergency builder in the compositions will suitably range from 5 to 80 wt %, preferably from 10 to 60 wt %.

Other ingredients that may suitably be incorporated in the base powder include fluorescers; antiredeposition, anti-dye-transfer and soil release polymers; sodium carbonate; sodium sulphate.

The base powder may also, if desired, contain sodium silicate. Generally the amount of sodium silicate present in the base powder will not exceed about 10 wt % of the whole composition, for example, from 1 to 8 wt %. The composition as a whole must, however, be free of postdosed sodium silicate other than that contained in the cogranules.

The base powder may be prepared by any suitable process giving composite granules, for example, spray-drying, spray-drying followed by densification, or non-tower mixing and granulation processes. The invention is believed to be especially applicable to compositions in which the base powder is not the direct by product of a spray-drying process.

Preferred non-tower processes use a high-speed mixer/granulator, for example, as described in EP 340 013A, EP 367 339A, EP 390 251A and EP 420 317A (Unilever).

The base powder preferably has a bulk density of at least 650 g/liter, more preferably at least 700 g/liter and most preferably at least 800 g/liter.

The sodium silicate/sodium carbonate cogranules

The compositions of the invention contain sodium silicate in the form of discrete cogranules comprising sodium silicate and sodium carbonate in a weight ratio of from 1:3 to 3:1.

Preferred cogranules have a sodium silicate to sodium carbonate ratio of from 0.5:1 to 1:1 and are present in an amount of from 2 to 15 wt %, more preferably from 4 to 10 wt %.

Composite sodium silicate/sodium carbonate granules and their use in detergent compositions are disclosed in EP 561 656A and WO 95 32273A (Rhône-Poulenc), EP 658 617A and EP 667 391A (Degussa), and WO 95 22592A (Henkel).

Especially preferred granules, containing 63.7 wt % (as anhydrous) sodium carbonate and 36.3 wt % (as hydrated disilicate) sodium silicate, are available commercially from Rhône-Poulenc Chimie as Nabion (Trade Mark) 15.

As previously indicated, the compositions of the invention are free of postdosed sodium silicate other than that contained in the cogranules. Sodium silicate may, however, be present in the base powder.

Sodium carbonate

Preferred compositions of the invention also contain from 1 to 50 wt %, preferably from 2 to 40 wt %, more preferably from 2 to 25 wt %, of postdosed sodium carbonate, that is to say, sodium carbonate present as discrete granules not forming part of the base powder. The absence of postdosed sodium carbonate appears to exacerbate the "granulation" problem.

Bleaching compositions may suitably contain from 1 to 12 wt %, preferably from 2 to 10 wt %, of postdosed sodium carbonate. Higher levels may be appropriate to non-bleaching compositions. Sodium carbonate may, of course, also be present in the base powder.

Bleach ingredients

The compositions of the invention may also contain a peroxy bleach compound. Preferred peroxy bleach compounds are inorganic persalts such as the alkali metal perborates, percarbonates, perphosphates, persilicates and persulphates, in particular, sodium perborate monohydrate and tetrahydrate and sodium percarbonate.

The present invention is especially applicable to compositions containing sodium percarbonate, which may suitably be present in an amount of from 10 to 35 wt %, more preferably from 15 to 25 wt %.

The peroxy bleach compound may be used in conjunction with a bleach activator (bleach precursor) to improve bleaching action at low wash temperatures. The bleach precursor is suitably present in an amount of from 1 to 8 wt %, preferably from 2 to 5 wt %. Preferred bleach precursors are peroxycarboxylic acid precursors, more especially peracetic acid precursors and peroxybenzoic acid precursors; and peroxycarbonic acid precursors. An especially preferred bleach precursor suitable for use in the present invention is N,N,N',N'-tetracetyl ethylenediamine (TAED).

A bleach stabiliser (heavy metal sequestrant) may also be present. Suitable bleach stabilisers include ethylenediamine tetraacetate (EDTA) and the polyphosphonates such as Dequest (Trade Mark), EDTMP.

As previously indicated, the scope of the invention also extends to non-bleaching compositions.

Other postdosed ingredients

Other non-base ingredients that may suitably be present include enzyme granules, antifoam granules, polymer granules (instead of or in addition to polymers included in the base powder), sodium bicarbonate, perfume.

Moisture sink capacity

Without wishing to be bound by theory, it has been observed that particulate laundry detergent compositions that exhibit a "granulation" problem that can be solved in accordance with the present invention are generally characterised by a calculated moisture sink capacity at 37° C. and 70% relative humidity of the overall composition of 5 wt % or less, preferably from 3 to 5 wt % and more preferably from 4 to 5 wt %.

Moisture sink capacity (MSC) is defined as the amount of water a material can take up to form a stable hydrate, under the defined conditions. Fully hydrated materials, for example, sodium perborate tetrahydrate, have no MSC.

For a single anhydrous or not fully hydrated material the MSC may readily be calculated, assuming that the material will hydrate fully, on storage under defined conditions, to the hydrate that is stable under those conditions. For example, under conditions of 37° C. and 70% relative humidity sodium carbonate (anhydrous) will hydrate to the monohydrate (in a closed container) or to the monohydrate plus sesquicarbonate (in open conditions in the presence of carbon dioxide), giving in either case an MSC value of 17 wt %; but will not hydrate further to the decahydrate which is only stable at higher relative humidity.

For a full particulate detergent composition, or a composite granular component of such a composition, the MSC value is calculated, for the purposes of the present invention, by adding up the capacities of the individual ingredients each multiplied by the percentage (anhydrous basis) of each present. This is necessarily an approximation because it assumes that the moisture sink capacity of each ingredient operates independently of the other ingredients present, whereas in reality it is likely that in a multiingredient component the different ingredients will influence each other to some extent.

The calculated MSC values at 370° C. and 70% relative humidity of some ingredients used in particulate detergent compositions of the invention and comparative compositions, as hereinafter described, are shown below.

| | MSC (wt %) |
|---|---|
| Zeolite 4A | zero |
| Zeolite MAP | 12.5 |
| Sodium carbonate* (anhydr) | 17.0 |
| Sodium disilicate (hydrated) | zero |
| Sodium carbonate (63.7 wt %)/sodium disilicate (36.3 wt %) cogranules | 11.0 |
| Antifoam granule (68 wt % carbonate) | 11.6 |
| Sodium sulphate | zero |
| Sodium perborate monohydrate | 54.0 |

-continued

| | MSC (wt %) |
|---|---|
| Sodium perborate tetrahydrate | zero |
| Sodium percarbonate | zero |
| Tetracetyl ethylene diamine (TAED) | zero |
| Sodium sesquicarbonate | zero |
| Sodium bicarbonate | zero |

EXAMPLES

The invention is illustrated by the following Examples, in which parts and percentages are by weight unless otherwise stated.

EXAMPLE 1.

Comparative Examples A to C

A high bulk density detergent base powder having a moisture sink capacity at 27° C. and 70% relative humidity of 3.8 wt % was prepared to the following formulation using a continuous high-speed mixer/granulator:

| | % |
|---|---|
| Na primary alcohol sulphate | 21.86 |
| Nonionic surfactant 7EO | 10.91 |
| Soap | 3.42 |
| Zeolite MAP (as anhydrous) | 42.27 |
| Light soda ash | 6.15 |
| Sodium citrate dihydrate | 4.33 |
| Sodium carboxymethyl cellulose | 1.70 |
| Moisture, salts, etc | 9.35 |

Four fully formulated detergent compositions were prepared by postdosing additional ingredients. The compositions thus obtained were tested for "granulation" by storing 100 g samples in open tubs for 60 hours at 37° C. and 70% relative humidity. Material having a particle size of 2000 $\mu$m or greater was then gently removed by sieving (the agglomerates were very fragile) and weighed. The compositions, and the percentages of oversize material found in each composition, are shown in the following Table.

| | A | | B | | C | | 1 | |
|---|---|---|---|---|---|---|---|---|
| | % | MSC | % | MSC | % | MSC | % | MSC |
| Base powder | 53.8 | 2.0 | 53.8 | 2.0 | 57.5 | 2.2 | 53.8 | 2.0 |
| Na carbonate | 8.4 | 1.4 | 6.4 | 1.1 | — | | 2.9 | 0.5 |
| Antifoam granule[1] | 3.8 | 0.4 | 3.8 | 0.4 | 4.1 | 0.5 | 3.8 | 0.4 |
| Disilicate granule | — | | 2.0 | | 2.0 | | — | |
| Silicate/carbonate[2] | — | | — | | — | | 5.5 | 0.6 |
| Polymer adjunct[3] | 5.0 | 0.5 | 5.0 | 0.5 | 5.3 | 0.5 | 5.0 | 0.5 |
| Sodium percarbonate | 19.00 | | 19.00 | | 19.00 | | 19.00 | |
| TAED | 5.50 | | 5.50 | | 5.50 | | 5.50 | |
| EDTMP | 1.00 | | 1.00 | | 1.00 | | 1.00 | |
| Granular copolymer[4] | 1.00 | | 1.00 | | 1.00 | | 1.00 | |
| Enzymes | 1.08 | | 1.08 | | 1.08 | | 1.08 | |
| Perfume | 0.45 | | 0.45 | | 0.45 | | 0.45 | |
| Total MSC | | 4.3 | | 4.0 | | 3.2 | | 4.0 |
| Granulation (wt % >2000 $\mu$m) | 2.0 | | 7.9 | | 10.5 | | 2.0 | |

-continued

| | A | | B | | C | | 1 | |
|---|---|---|---|---|---|---|---|---|
| | % | MSC | % | MSC | % | MSC | % | MSC |

[1]containing 18 wt % carbonate
[2]Nabion 15 ex Rhône-Poulenc: 63.7 wt % carbonate, 36.3 wt % silicate
[3]Sokalan (Trade Mark) HP22 soil release polymer ex BASF on zeolite/carbonate carrier
[4]Sokalan (Trade Mark) CP5 acrylic/maleic copolymer ex BASF.

Comparative Example A contained no sodium silicate and showed very low "granulation". Addition of 2 wt % postdosed disilicate (Comparative Example B), replacing the same amount of postdosed sodium carbonate, resulted in a large increase in "granulation". Removal of all postdosed carbonate (replacing by base powder) caused granulation to increase further (Comparative Example C).

However, replacement of the postdosed silicate and part of the postdosed sodium carbonate of Comparative Example B by sodium silicate/sodium carbonate composite granules (Nabion 15), to give exactly the same final formulation, caused the "granulation" level to fall back to that of Comparative Example A containing no sodium silicate.

What is claimed is:

1. A particulate zero-phosphate laundry detergent composition comprising:

(i) from 30 to 80 wt % of a granular base powder comprising (a) from 5 to 60 wt %, based on the composition, of organic surfactant, and (b) from 10 to 80 wt %, based on the composition, of alkali metal aluminosilicate detergency builder, (ii) from 1 to 5 wt % of sodium silicate not within the granular base powder, all of said sodium silicate being present in the form of separate cogranules consisting essentially of sodium silicate and sodium carbonate in a weight ratio within the range of from 3:1 to 1:3, said composition containing from 2 to 10 wt % of said cogranules and said composition being free of postdosed sodium silicate other than that contained in said cogranules, (iii) from 2 to 10 wt % of postdosed granules of sodium carbonate, (iv) from 10 to 35 wt % of postdosed granules of a peroxy bleach compound; and (v) optionally other detergent ingredients to 100 wt %, whereby the tendency of the composition to form granules having a particle size of 2000 μm or larger on storage is less than if the sodium silicate (ii) were present in the form of separate granules of sodium disilicate.

2. A detergent composition as claimed in claim 1, wherein the alkali metal aluminosilicate builder is zeolite MAP.

3. A detergent composition as claimed in claim 2, which contains from 20 to 60 wt % of zeolite MAP.

4. A detergent composition as claimed in claim 2, which is free of zeolite A.

5. A detergent composition as claimed in claim 1, wherein the sodium silicate/sodium carbonate cogranules contain sodium silicate and sodium carbonate in a weight ratio of from 0.5:1 to 1:1.

6. A detergent composition as claimed in claim 1, which comprises as peroxy bleach compound (iv) sodium percarbonate.

7. A detergent composition as claimed in claim 1, wherein the granular base powder (i) is not the direct product of a spray-drying process.

8. A detergent composition as claimed in claim 1, (having) wherein the granular base powder has a bulk density of at least 650 g/liter.

9. A detergent composition as claimed in claim 1 having a calculated moisture sink capacity at 37° C. and 70% relative humidity not exceeding 5 wt %.

10. A detergent composition as claimed in claim 1, having a calculated moisture sink capacity at 37° C. and 70% relative humidity within the range of from 3 to 5 wt %.

11. A detergent composition as claimed in claim 1, having a calculated moisture sink capacity at 37° C. and 70% relative humidity within the range of from 4 to 5 wt %.

12. A process for reducing the tendency of a particulate zero-phosphate zeolite-built detergent composition to form granules having a particle size of 2000 μm or above on storage, the composition comprising from 30 to 80 wt % of a granular base powder comprising (a) from 5 to 60 wt %, based on the composition, of organic surfactant, and (b) from 10 to 80 wt %, based on the composition, of alkali metal aluminosilicate detergency builder, optionally from 10 to 35 wt % of postdosed granules of a peroxy bleach compound, and optionally other detergent ingredients to 100 wt %, which process comprises incorporating in said composition from 2 to 10 wt % of postdosed cogranules consisting essentially of sodium silicate and sodium carbonate in a weight ratio within the range of from 3:1 to 1:3, said cogranules containing from 1 to 5 wt %, based on the composition, of sodium silicate, said composition being otherwise free of postdosed sodium silicate, and which process further comprises incorporating in said composition from 1 to 50 wt %, based on the composition, of postdosed sodium carbonate granules.

* * * * *